US010246227B2

(12) United States Patent
Wada et al.

(10) Patent No.: US 10,246,227 B2
(45) Date of Patent: Apr. 2, 2019

(54) LIDDED CONTAINER

(71) Applicant: TOPPAN PRINTING CO., LTD., Tokyo (JP)

(72) Inventors: Kiyoshi Wada, Tokyo (JP); Osamu Urushibara, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 15/702,699

(22) Filed: Sep. 12, 2017

(65) Prior Publication Data

US 2018/0009579 A1 Jan. 11, 2018

Related U.S. Application Data

(63) Continuation of application No. PCT/JP2016/001207, filed on Mar. 4, 2016.

(30) Foreign Application Priority Data

Mar. 26, 2015 (JP) ..... 2015-064987

(51) Int. Cl.
*B65D 43/22* (2006.01)
*B65D 45/32* (2006.01)
(Continued)

(52) U.S. Cl.
CPC ..... *B65D 45/32* (2013.01); *B65D 43/162* (2013.01); *B65D 43/163* (2013.01); *B65D 43/22* (2013.01);
(Continued)

(58) Field of Classification Search
CPC ..... B65D 45/32; B65D 43/163; B65D 2543/00518; B65D 2543/00537;
(Continued)

(56) References Cited

U.S. PATENT DOCUMENTS 3,596,694 A * 8/1971 Jaeniche ..... B65D 39/04 215/43
4,639,386 A * 1/1987 Akao ..... B65D 43/021 428/36.92
(Continued)

FOREIGN PATENT DOCUMENTS

EP 0 454 967 A2 11/1991
GB 2 240 322 A 7/1991
(Continued)

OTHER PUBLICATIONS

International Search Report for International Patent Application No. PCT/JP2016/001207 dated May 31, 2016.
(Continued)

*Primary Examiner* — J. Gregory Pickett
*Assistant Examiner* — Niki M Eloshway
(74) *Attorney, Agent, or Firm* — Foley & Lardner LLP

(57) ABSTRACT

In a container having a lid member coupled to a container body by a hinge, the lid member has a top panel, and an inner ring formed on the top panel, the inner ring being fitted to an inner peripheral surface of a sidewall of the container body in a closed state to seal the container body. The inner ring has an outer peripheral surface on which an outer peripheral surface projection is formed along a circumferential direction, and the container body has an inner peripheral surface on which an inner peripheral surface projection is formed along the circumferential direction, in the vicinity of an end portion of the sidewall. When closing the lid member, the outer peripheral surface projection contacts and slides over the inner peripheral surface projection to cause the lid member to be locked to the container body, with the inner ring sealing the container body.

8 Claims, 4 Drawing Sheets

(51) Int. Cl.
*B65D 43/16* (2006.01)
*B65D 43/14* (2006.01)

(52) U.S. Cl.
CPC ..... *B65D 2543/0049* (2013.01); *B65D 2543/00518* (2013.01); *B65D 2543/00537* (2013.01); *B65D 2543/00555* (2013.01); *B65D 2543/00629* (2013.01); *B65D 2543/00685* (2013.01); *B65D 2543/00731* (2013.01); *B65D 2543/00796* (2013.01); *B65D 2543/00842* (2013.01)

(58) Field of Classification Search
CPC ..... B65D 2543/00555; B65D 43/162; B65D 43/22; B65D 2543/0049
USPC ..... 220/834, 801, 789
See application file for complete search history.

(56) References Cited

U.S. PATENT DOCUMENTS 4,730,745 A * 3/1988 Perry ..... B65D 55/0863 215/230
5,106,665 A * 4/1992 Akao ..... C08K 5/1575 206/407
5,254,314 A 10/1993 Yu et al.
5,791,473 A * 8/1998 Decker ..... B65D 43/021 206/316.1
5,975,346 A * 11/1999 Imperato ..... B44D 3/123 220/284
6,240,930 B1 6/2001 Yuhara
8,800,798 B2 * 8/2014 Abrahamsson ..... B29C 45/006 220/359.1
9,694,955 B2 * 7/2017 Wu ..... B65D 50/00
2007/0084735 A1 * 4/2007 Lancesseur ..... B65D 43/164 206/204
2011/0000930 A1 * 1/2011 Logel ..... B65D 43/162 220/849
2014/0319162 A1 10/2014 Bois et al.
2015/0259115 A1 9/2015 Yeh

FOREIGN PATENT DOCUMENTS

JP 06-078265 U 11/1994
JP 11-263359 A 9/1999
JP 2000-236937 A 9/2000
JP 2008-297010 A 12/2008

OTHER PUBLICATIONS

Extended European Search Report dated Dec. 15, 2017 in corresponding application No. EP 16767959.6.
English translation of First Office Action regarding correspondence Chinese Application No. 201680013071.2, dated Aug. 2, 2018, 2 pps.
Search Report and Office Action regarding Chinese Application No. 201680013071.2, dated Aug. 2, 2018, 7 pps.

* cited by examiner

LIDDED CONTAINER

CROSS-REFERENCE TO RELATED PATENT APPLICATIONS

This application is a continuation application filed under 35 U.S.C. § 111(a) claiming the benefit under 35 U.S.C. §§ 120 and 365(c) of International Application No. PCT/JP2016/001207, filed on Mar. 4, 2016, which is based upon and claims the benefit of priority of Japanese Patent Application No. 2015-064987, filed on Mar. 26, 2015, the entireties of which are hereby incorporated by reference.

TECHNICAL FIELD

The present invention relates to a container that includes a container body and a lid member that seals an opening portion of the container body.

BACKGROUND

There is known a container that includes a lid member coupled to a container body by a hinge so as to be openable/closable relative to an opening portion of the container body. FIG. 4 shows a cross section of such a container 900. In the container 900, a lid member 911 is closed in such a way that a sidewall 922 and an inner ring 912 provided to the lid member 911 sandwich an opening portion of a container body 901. At this time, in order to enhance sealing properties, the inner ring 912 is fitted to an inner peripheral surface of the opening portion of a sidewall 902 of the container body 901. The sidewall 922 of the lid member 911 has an inner peripheral surface on which a projection 914 is formed along the circumferential direction. The sidewall 902 of the container body 901 has an outer peripheral surface on which a recess 903 is formed along the circumferential direction. In the state where the lid member is closed, the projection 914 and the recess 903 are engaged with each other to lock the lid member 911 so as not to be opened.

PRIOR ART LITERATURE

Citation List

Patent Literature
[PTL 1] JP 2008-297010 A

SUMMARY OF THE INVENTION

Technical Problem

In such a container, when closing the lid member, the projection slides over the opening portion of the container body. In this case, the sidewall of the lid member receives resistance from the opening portion, which results in displacement and expansion of the sidewall radially outward. In conformity with this displacement, the inner ring is also displaced and expands radially outward. Thus, a large force is needed for closing the lid member, because the inner ring has to be strongly pressed against the inner wall of the opening portion when the inner ring is fitted to an inner wall. Further, since the sidewall is provided to a lid member, the outer diameter of the lid member is increased accordingly, which may lead to degradation of the design. Additionally, since the sidewall and the inner ring of the lid member sandwich the container body, closing the lid member narrows the path for the air to escape and raises the inner pressure. Consequently, the lid tends to float in a closed state, which may lead to insufficient sealing of the container, or opening of the lid when not desired.

An object of the present invention is to provide a container that has a lid member coupled to a container body by a hinge, the container enabling easier and reliable closing operation of the lid member while improving the design.

Solution to the Problem

An aspect of the present invention is a container that includes a cylindrical container body, and a lid member coupled to the container body by a hinge so as to be openable/closable relative to an opening portion of the container body. The lid member has a top panel and an inner ring formed on the top panel, the inner ring being fitted to an inner peripheral surface of a sidewall of the container body in a closed state to seal the container body. The inner ring has an outer peripheral surface on which an outer peripheral surface projection is formed along a circumferential direction, and the container body has an inner peripheral surface on which an inner peripheral surface projection is formed along the circumferential direction, in the vicinity of an end portion of the sidewall. When closing the lid member, the outer peripheral surface projection contacts and slides over the inner peripheral surface projection to cause the lid member to be locked to the container body, with the inner ring sealing the container body.

When closing the lid member, the inner ring may seal the container body after the outer peripheral surface projection contacts and slides over the inner peripheral surface projection.

The lid member and the end portion of the sidewall of the container body may have the same outer diameter, and in a closed state, the top panel of the lid member may come in contact with the end portion of the sidewall of the container body.

The lid member may have a peripheral edge portion on an opposite side to where the lid member is coupled to the hinge, the peripheral edge portion being formed with a flange having an upper surface flush with an upper surface of the top panel of the lid member.

Advantageous Effects of the Invention

In the container of the present invention having the lid member coupled to the container body by a hinge, closing of the lid member can be carried out more easily and reliably, while improving the design.

BRIEF DESCRIPTION OF THE DRAWINGS

FIGS. 2A-2C are a set of diagrams in which FIG. 2A is a partial enlarged cross section of a container according to an embodiment of the present invention, and FIGS. 2B and 2C are partial enlarged cross sections of containers according to modifications of the present invention.

DESCRIPTION OF REPRESENTATIVE EMBODIMENTS

Figure 1:
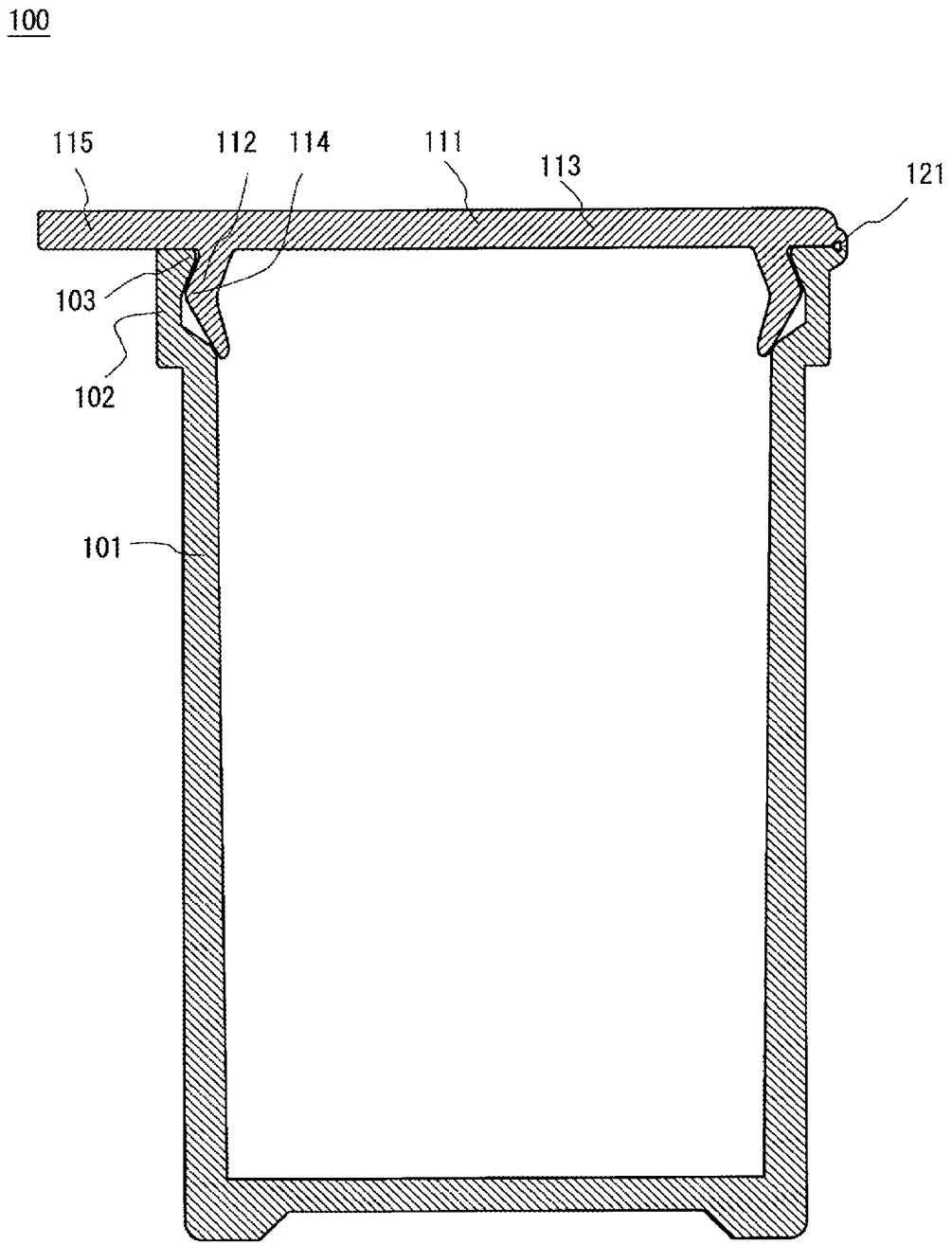
FIG. 1 is a cross section of a container according to an embodiment of the present invention.
Figure 2A:
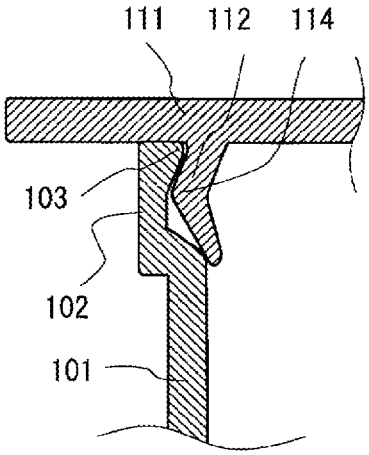

A container 100 according to an embodiment of the present invention will be described. The container 100 includes a cylindrical container body 101 having a sidewall 102, and a lid member 111. The container body 101 and the lid member 111 are coupled to each other by a hinge 121. FIG. 1 is a longitudinal cross section of the container 100 in a state where the lid member 111 is closed, taken by a plane that passes through a central axis of the container body 101 and the hinge 121. FIG. 2A is a partial enlarged view of the longitudinal cross section shown in FIG. 1.

The lid member 111 has a top panel 113 and an inner ring 112. The inner ring 112 is formed on the top panel 113, and fitted to the inner peripheral surface of the sidewall 102 of the container body 101 to seal the container body 101, in the state where the lid member 111 is closed.

The inner ring 112 has an outer peripheral surface on which an outer peripheral surface projection 114 is formed along the circumferential direction. Also, the sidewall 102 of the container body 101 has an inner peripheral surface on which an inner peripheral surface projection 103 is formed along the circumferential direction, in the vicinity of the end portion.

When closing the lid member 111, the outer peripheral surface projection 114 comes into contact with and slides over the inner peripheral surface projection 103 to thereby lock the lid member 111 to the container body 101, with the inner ring 112 sealing the container body 101.

The lid member 111 has a peripheral edge portion which faces a portion where the lid member 111 is coupled to the hinge 121. The peripheral edge portion is formed with a flange 115. The flange 115 and the top panel 113 are preferably shaped such that the respective upper surfaces are flush with each other to provide a planar surface.

Figure 2B:
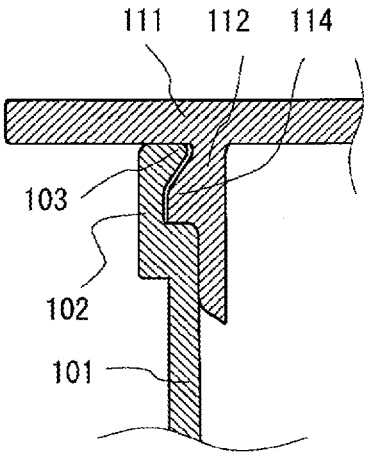
Figure 2C:
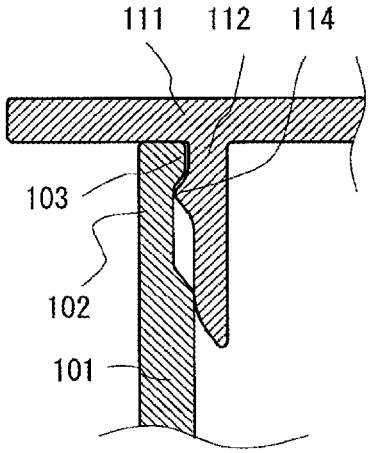

In the example shown in FIG. 2A, the inner ring 112 has a cross section in a doglegged shape. The sidewall 102 of the container body 101 is in a curved shape to facilitate elastic deformation, described later, and relieve stiffness. In another example shown in FIG. 2B, the inner ring 112 has an outer peripheral surface projection 114 having a chamfered and rounded triangular cross section. In the cross section, the inner peripheral surface projection 103 of the sidewall 102 and its vicinity are shaped in conformity with the outer peripheral surface of the inner ring 112, and are curved to relieve stiffness. In another example shown in FIG. 2C, a rib is formed as the outer peripheral surface projection 114, and the thickness of the sidewall 102 is decreased in the portion right beneath the inner peripheral surface projection 103 to thereby relieve stiffness. In this way, the cross-sectional shape of the inner ring 112 and the sidewall 102 can be varied.

The outer peripheral surface projection 114 may be formed throughout the perimeter of the inner ring 112, or may be partially formed along the circumferential direction. To secure strength, a plurality of ribs may be formed on the top panel 113 so as to radially extend from the center.

An example of how the lid member 111 is opened/closed will hereinafter be described. FIGS. 3A-3D are a set of diagrams showing, as an example, cross sections in the vicinity of the flange 115 of the container 100 in the process of opening/closing the lid member 111 shown in FIG. 2A.

Figure 3A:
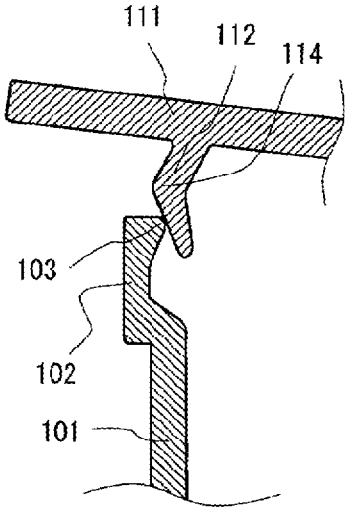
FIGS. 3A-3D are a set of diagrams in which FIGS. 3A, 3B, 3C, and 3D each show a partial enlarged cross section of a container according to an embodiment of the present invention.

When closing the lid member 111 from its opened state using the hinge 121 as an axis, the outer peripheral surface projection 114 firstly comes into contact with the inner peripheral surface projection 103 as shown in FIG. 3A.

Figure 3B:
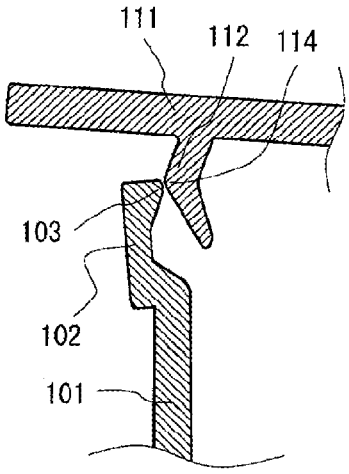
Figure 3C:
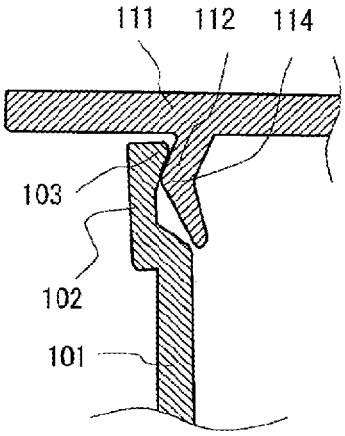

Afterwards, as shown in FIG. 3B, the sidewall 102 elastically deforms radially outward, and the inner ring 112 elastically deforms radially inward. Further, as shown in FIG. 3C, the outer peripheral surface projection 114 comes into contact with and slides over the inner peripheral surface projection 103. The expression "slides over" refers to the fact that the peak portion of the outer peripheral surface projection 114 passes over the peak portion of the inner peripheral surface projection 103, and then the sidewall 102 and the inner ring 112 start recovering from the deformed state.

Figure 3D:
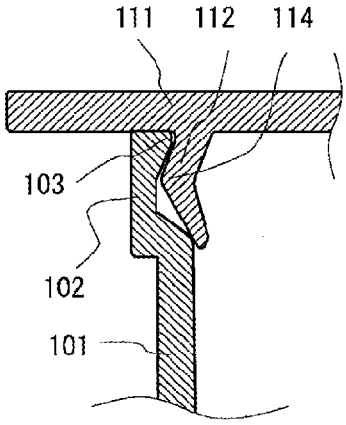
Figure 4:
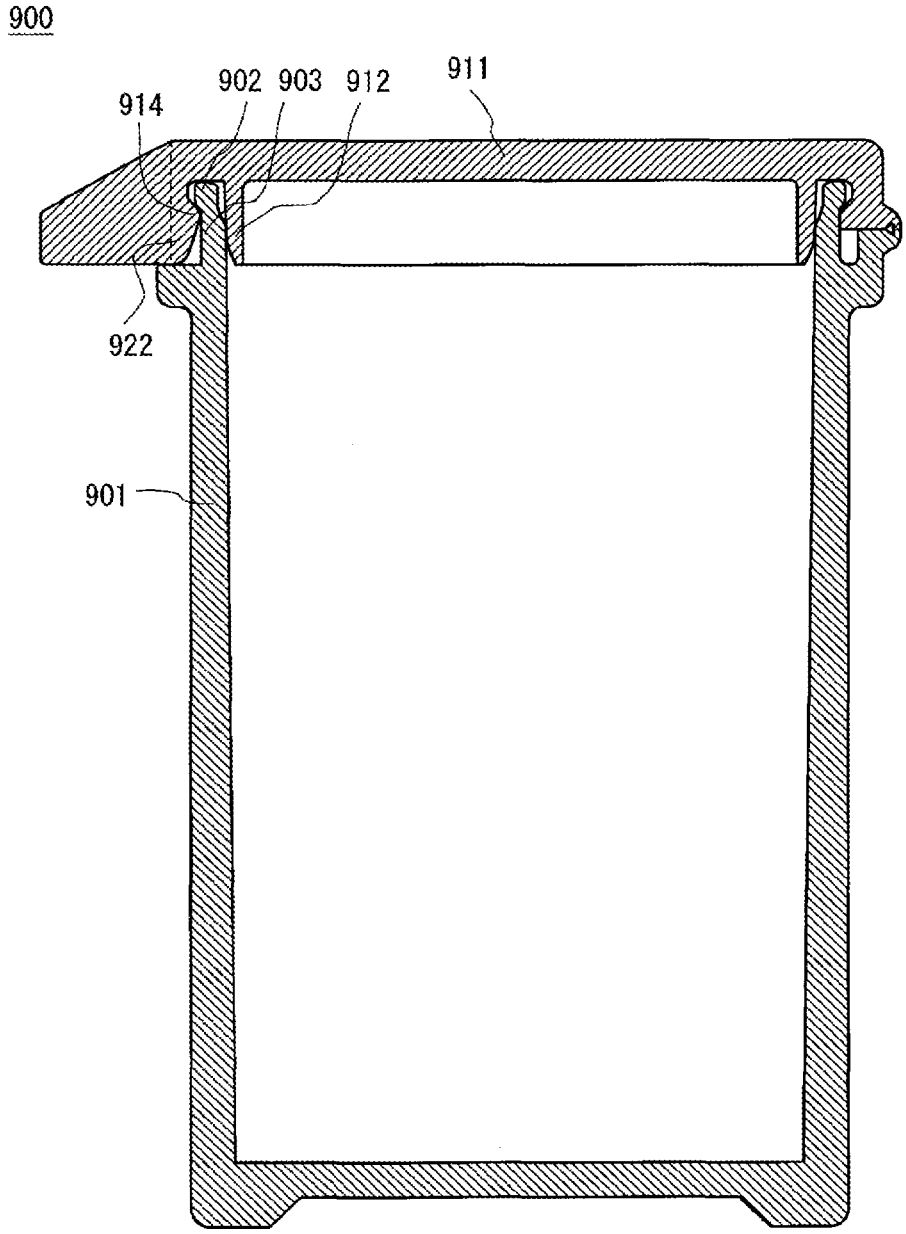
FIG. 4 is a cross section of a conventional container.

Afterwards, as shown in FIG. 3D, the inner ring 112 contacts and slides over the sidewall 102 so as to be fitted thereto to thereby seal the container body 101. At the same time, with the outer peripheral surface projection 114 and the inner peripheral surface projection 103 being engaged with each other, the lid member 111 and the container body 101 are locked to each other, and recovery from the deformed state is completed to thereby close the container body 101. In such a way, it is preferred that the container body 101 is sealed after the outer peripheral surface projection 114 slides over the inner peripheral surface projection 103. This is because the amount of the fitting that continues after completion of the sealing can be made small, and the inner pressure of the container body 100 is unlikely to rise. However, not being limited to this, the timing for the outer peripheral surface projection 114 and the inner ring 112 to contact the sidewall 102, and the timing for the inner ring 112 to conduct sealing may be different from what is described above. It is preferred that there is a gap of approximately 0.02 mm in the engaged portion in the closed state.

When the lid member 111 is opened from the closed state using the hinge 121 as an axis, a process that is the reverse of the process described above is taken. Specifically, from the state shown in FIG. 3D, the inner ring 112 slides over and becomes separated from the inner peripheral surface of the container body 101 (FIG. 3C), and then, the peak portion of the outer peripheral surface projection 114 slides over the peak portion of the inner peripheral surface projection 103 (FIG. 3A and FIG. 3B), with the sidewall 102 and the inner ring 112 elastically deformed. Further, the outer peripheral surface projection 114 is separated from the inner peripheral surface projection 103, exposing the opening portion of the container body 101, to thereby open the container body 101. The same applies to other examples shown in FIG. 2B and FIG. 2C.

In the container 100, when closing the lid member 111, the lid member 111 contacts the sidewall 102 of the container body 101, via the inner ring 112, only from inside the sidewall 102. Also, the lid member 111 does not cover the outer peripheral surface of the sidewall 102 of the container body 101.

Therefore, the inner ring 112 favorably functions as a guide for adjusting position, making it easier for the central axes of the lid member 111 and the container body 101 to align with each other in the course of achieving the closed state. When the outer peripheral surface projection 114 slides over the inner peripheral surface projection 103, the sidewall 102 is expanded radially outward. This reduces friction at the time when the end of the inner ring 112 is fitted to the inner peripheral surface of the sidewall 102. For these reasons, resistance that would be caused by unnecessary interference between the lid member 111 and the container body 101 can be prevented from occurring, thereby enabling stable opening/closing motion with a small force. Accordingly, by increasing the contact area of the inner ring 112 with the inner peripheral surface of the sidewall 102, the sealing performance can be improved. Further, the flange 115 can be made small. Also, the closing operation can also be conducted by depressing the center of the top panel 113.

In addition, since the top panel 113 of the lid member 111 is in contact with the sidewall 102 of the container body 101 in a closed state, the closed state can be directly and visually confirmed. Thus, insufficient closing can be prevented because the insufficiency of the closing operation can be immediately detected by at least confirming floating of the lid member 111 from the container body 101 due to partial non-contact of the top panel 113 with the sidewall 102.

By allowing the lid member 111 and the end portion of the sidewall 102 of the container body 101 to have the same outer diameter, the planar top panel 113 can cover at least the opening portion of the container body 101, providing a fine look to the container and improves design. By aligning the side surfaces so that the peripheral edge of the lid member 111 does not protrude, undesired opening of the lid member 111 is prevented, which would otherwise occur by the impact of dropping that locally works on the lid member 111.

Since the air easily escapes during closing motion of the lid member 111, the inner pressure inside the container is unlikely to rise, and the lid member 111 is unlikely to float in the closed state. Therefore, the closed state is stably maintained.

By providing a shape in which the upper surface of the flange 115 is flush with the upper surface of the top panel 113, the push-down surface of the flange 115 is prevented from hanging over the sidewall 102 of the container body 101. Thus, the stroke of pushing up/down the flange 115 at the time of opening/closing the container is reduced.

As described above, in the container having the lid member connected to the container body by a hinge according to the present invention, closing operation of the lid member can be conducted more easily and reliably, while improving the design. The features mentioned above may be omitted or modified as appropriate. It is also to be understood that the embodiments described above are intended to be representative of the present invention. The present invention is not necessarily limited to the description set forth above.

INDUSTRIAL APPLICABILITY

The present invention is useful as a container that includes a container body and a lid member sealing an opening portion of the container body. Specifically, the present invention is useful as a container for accommodating pharmaceutical products, reagents and sensors such as for blood glucose level, and the like where high sealability and repetitive opening/closing are required.

REFERENCE SIGNS LIST

100 Container
101 Container body
102 Sidewall
103 Inner peripheral surface projection
104 First inner peripheral surface
105 Second inner peripheral surface
111 Lid member
112 Inner ring
113 Top panel
114 Outer peripheral surface projection
115 Flange
116 Projection
121 Hinge

What is claimed is:

1. A container, comprising:

a cylindrical container body, and a lid member coupled to the container body by a hinge so as to be openable/closable relative to an opening portion of the container body, wherein the lid member has a top panel and an inner ring formed on the top panel, the inner ring being fitted to an inner peripheral surface of a sidewall of the container body in a closed state to seal the container body;

wherein the inner ring has an outer peripheral surface on which an outer peripheral surface projection is formed along a circumferential direction;

wherein the container body has an inner peripheral surface on which an inner peripheral surface projection is formed along the circumferential direction, in the vicinity of an end portion of the sidewall;

wherein, when closing the lid member, the outer peripheral surface projection contacts and slides over the inner peripheral surface projection to cause the lid member to be locked to the container body, with the inner ring sealing the container body;

wherein one side of the sidewall has a portion which is open to contents of the container;

wherein a rib is formed as the outer peripheral surface projection, and a thickness of the sidewall is decreased in a portion beneath the inner peripheral surface projection to relieve stiffness;

wherein an axially symmetric gap is formed beneath the rib and above a position where the inner ring contacts the sidewall below the portion of the sidewall having the decreased thickness;

wherein the inner ring includes a straight cylindrical section that extends below the inner peripheral surface projection and defines a first side of the gap;

wherein a lower surface of the inner peripheral surface projection defines a second side of the gap, the second side being inclined with respect to the first side;

wherein the portion of the sidewall having the decreased thickness defines a third side of the gap which is opposed to the first side, and wherein the sidewall, at a portion below the portion that is decreased in thickness, defines a fourth side of the gap and is inclined with respect to the third side and is opposed to the second side.

2. The container of claim 1, wherein, when closing the lid member, the inner ring seals the container body after the outer peripheral surface projection contacts and slides over the inner peripheral surface projection.

3. The container of claim 1, wherein the lid member and the end portion of the sidewall of the container body have the same outer diameter, and in a closed state, the top panel of the lid member comes into contact with the end portion of the sidewall of the container body.

4. The container of claim 1, wherein:

the lid member has a peripheral edge portion facing a portion where the lid member is coupled to the hinge, the peripheral edge portion being formed with a flange having an upper surface flush with an upper surface of the top panel of the lid member.

5. A container, comprising:

a cylindrical container body, and a lid member coupled to the container body by a hinge so as to be openable/closable relative to an opening portion of the container body, wherein the lid member has a top panel and an inner ring formed on the top panel, the inner ring being fitted to an inner peripheral surface of a sidewall of the container body in a closed state to seal the container body;

wherein the inner ring has an outer peripheral surface on which an outer peripheral surface projection is formed along a circumferential direction;

wherein the container body has an inner peripheral surface on which an inner peripheral surface projection is formed along the circumferential direction, in the vicinity of an end portion of the sidewall;

wherein, when closing the lid member, the outer peripheral surface projection contacts and slides over the inner peripheral surface projection to cause the lid member to be locked to the container body, with the inner ring sealing the container body;

wherein the lid member and the end portion of the sidewall of the container body have the same outer diameter;

wherein a rib is formed as the outer peripheral surface projection, and a thickness of the sidewall is decreased in a portion beneath the inner peripheral surface projection to relieve stiffness;

wherein an axially symmetric gap is formed beneath the rib and above a position where the inner ring contacts the sidewall below the portion of the sidewall having the decreased thickness;

wherein the inner ring includes a straight cylindrical section that extends below the inner peripheral surface projection and defines a first side of the gap;

wherein a lower surface of the inner peripheral surface projection defines a second side of the gap, the second side being inclined with respect to the first side;

wherein the portion of the sidewall having the decreased thickness defines a third side of the gap which is opposed to the first side, and wherein the sidewall, at a portion below the portion that is decreased in thickness, defines a fourth side of the gap and is inclined with respect to the third side and is opposed to the second side.

6. The container of claim 1, wherein the outer peripheral surface of the inner ring has a chamfered and rounded triangular cross-section substantially conforming to a cross-section of the inner peripheral surface projection.

7. The container of claim 6, wherein at least a portion of the outer peripheral surface of the inner ring and the inner peripheral surface projection are curved to relieve stiffness.

8. The container of claim 1, wherein a rib is formed as the outer peripheral surface projection, and a thickness of the sidewall is decreased in a portion beneath the inner peripheral surface projection to relieve stiffness.

* * * * *